US005451842A

United States Patent [19]

Chien

[11] Patent Number: 5,451,842

[45] Date of Patent: Sep. 19, 1995

[54] ELECTRO-LUMINESCENT SEASONAL LIGHT APPARATUS

[76] Inventor: Tseng-Lu Chien, 8th Fl.-6, No. 9, San Min Rd., Taipei, Taiwan

[21] Appl. No.: 213,617

[22] Filed: Mar. 15, 1994

[51] Int. Cl.[6] ..... H05B 37/00

[52] U.S. Cl. ..... 315/185 S; 315/200 A; 315/169.3; 315/209 R; 362/35; 362/806; 362/808

[58] Field of Search ..... 315/200 A, 324, 209 R, 315/161, 212, 169.3, 186, 185 S, 179, 201, 360; 362/806, 807, 84, 35, 124, 808

[56] References Cited

U.S. PATENT DOCUMENTS

| | | | |
|---|---|---|---|
| 2,717,336 | 9/1955 | Craddock | 315/324 |
| 3,047,762 | 7/1962 | Edens et al. | 315/200 A |
| 4,340,842 | 7/1982 | King et al. | 315/186 |
| 4,367,417 | 1/1983 | Cassanta | 315/324 X |
| 4,544,218 | 10/1985 | Sanders et al. | 339/31 L |
| 4,591,764 | 5/1986 | Nilssen | 315/324 X |
| 4,682,079 | 7/1987 | Sanders et al. | 315/186 |
| 4,989,120 | 1/1991 | Davis et al. | 362/35 |
| 5,003,227 | 3/1991 | Nilssen | 315/324 X |
| 5,245,519 | 9/1993 | Openiano | 362/806 X |

*Primary Examiner*—Benny Lee
*Assistant Examiner*—Haissa Philogene
*Attorney, Agent, or Firm*—Kirkpatrick & Lockhart

[57] ABSTRACT

An electro-luminescent seasonal light apparatus includes a pig-tail plug mated with one pig-tail socket which extends from a regular seasonal Christmas/Halloween light string and provides a first AC power having a first voltage and a first frequency, an extension wire electrically connected to the pig-tail plug, a circuit box electrically connected to the extension wire for converting the first AC power to a second AC power which has a second voltage and a second frequency, an electro-luminescent component electrically connected to the circuit box for receiving the second AC power and flashing thereby, and a pattern shaper attached to the electro-luminescent component.

1 Claim, 3 Drawing Sheets

ELECTRO-LUMINESCENT SEASONAL LIGHT APPARATUS

FIELD OF THE INVENTION

The present invention relates to an electro-luminescent (EL) seasonal light apparatus.

BACKGROUND OF THE INVENTION

Traditional neon lights have a relatively high illumination and thus are used frequently in outdoor advertisements. However, these neon lights are apt to cause danger due to a requirement of relatively high current for powering the neon lights. Therefore, neon lights are not frequently used in indoor light decorations, such as the decoration lights for a Christmas tree. Some people utilize LED light strings as the most popular way to decorate a Christmas tree, yet the work involved in solding each LED is cumbersome. Additionally, the number of the LEDs are relatively large and if one or more of the LEDs malfunction, the total outlook of the Christmas tree is negatively affected. It is requisite to provide a safe and convenient light apparatus for decoration or advertisement use. An EL-based light apparatus can provide neon-like color and illumination and does not require cumbersome soldering work as does the LED light apparatus.

SUMMARY OF THE INVENTION

It is an object of the present invention to provide an electro-luminescent (EL) light apparatus which is easily installed and is safe when in use.

DETAILED DESCRIPTION OF THE PREFERRED EMBODIMENTS

Figure 1:
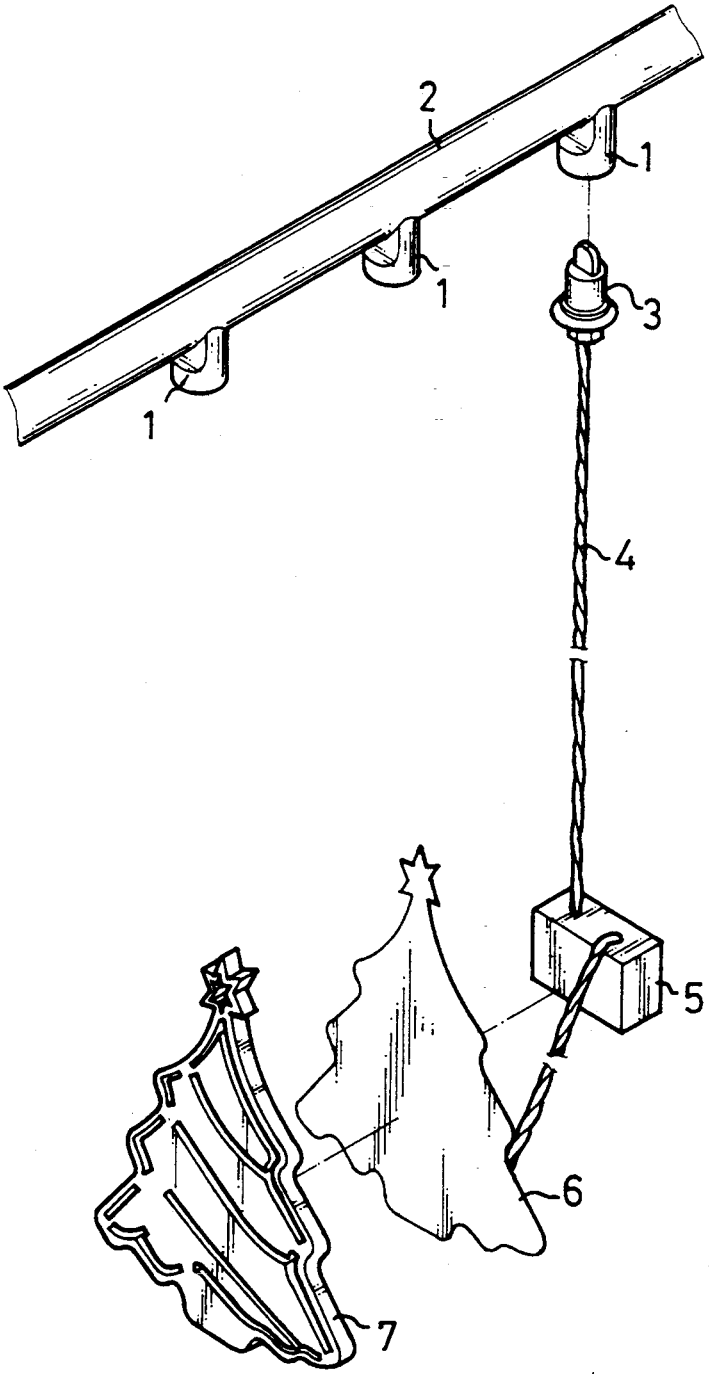
FIG. 1 illustrates an exploded view of a first embodiment of an electro-luminescent seasonal light apparatus in accordance with the present invention.
Figure 2:
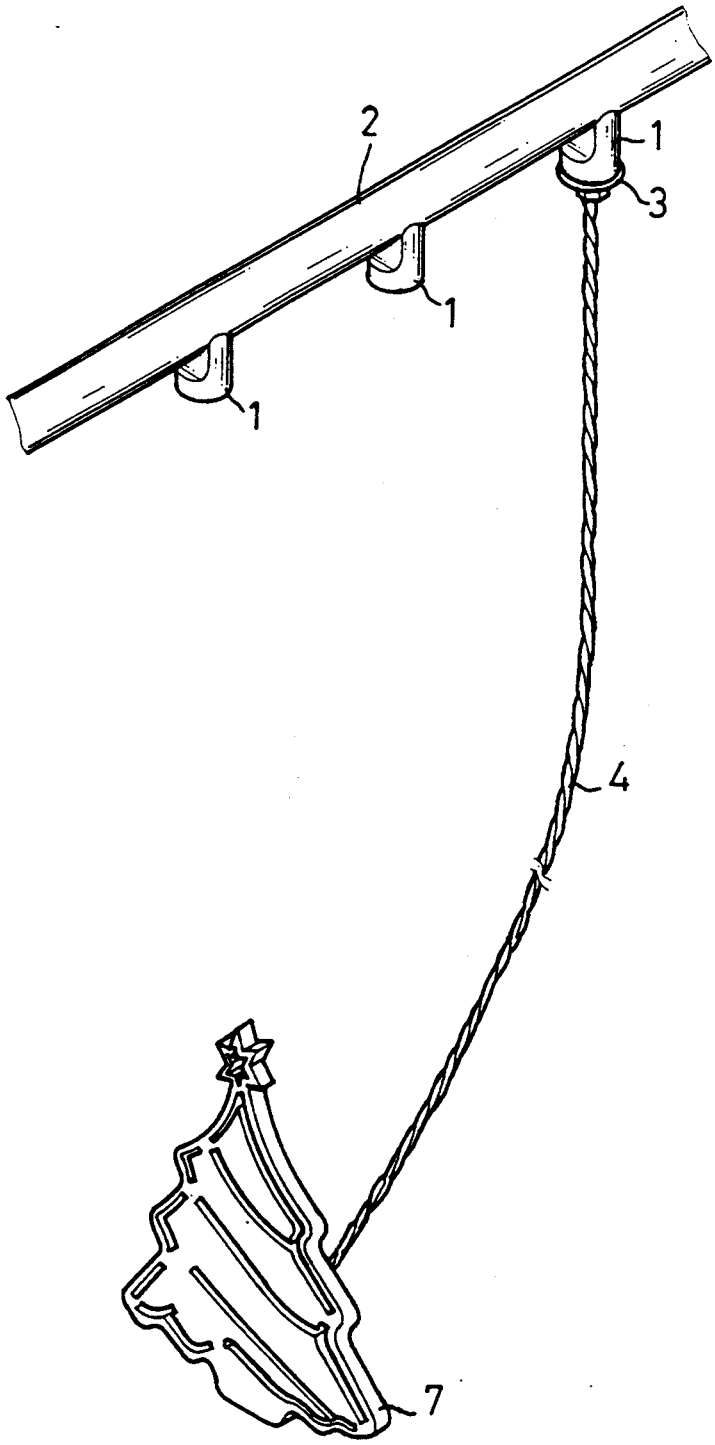
FIG. 2 is an assembled view of FIG. 1.

Referring to FIG. 1, an electro-luminescent (EL) light apparatus in accordance with the present invention comprises a pig-tail plug 3 mated with a pig-tail socket 1 which extends from an external power line 2 of a conventional Christmas/Halloween light string, an extension wire 4 electrically connected to the pig-tail plug 3, a circuit box 5 electrically connected to the extension wire 4, an EL component 6 electrically connected to the circuit box 5, and a mask 7 attached with the EL component 6. For simplification, merely one unit of the electro-luminescent light apparatus is shown in FIG. 1. It should be noted that the number of the electro-luminescent light apparatus for replacing the conventional lamps on the conventional Christmas/-Halloween string is not limited. A user can replace the conventional lamps on the light string with as many of the electro-luminescent light apparatuses of the present invention as desired. Also referring to FIG. 2, the pig-tail plug 3 is inserted into the pig-tail socket 1. The circuit box 5, the EL component 6, and the mask 7 are attached together by glue or the like and the glue prevents water from coming into the circuit box 5. The circuit box 5 comprises a voltage pull-up and a frequency changer which are well known and are not described in more detail herein. The pig-tail socket 1 provides a first AC power of 3.5 volts and 60 hertz. The first AC power is transmitted from the pig-tail socket 1 to the circuit box 5 via the pig-tail plug 3 and the extension wire 4. A second AC power of 110 volts and 400 hertz is obtained at two output terminals of the circuit box 5 via voltage pull-up and frequency change therein. The second AC power is allowed to activate the EL component 6 to light up. It should be noted that the EL component 6 may light up with different manners such as lighting up at all time, flashing at all time, or lighting up for a time period and flashing for another time period alternately depending on the first AC power. The mask 7 has a contour substantially identical to that of the EL component 6. The mask 7 has a plurality of holes formed therein through which the light from the EL component 6 is visible. It should be noted that a plurality of pig-tail sockets 1 are allowed to be attached to the external wire 2 thus allowing a corresponding number of EL components 6 to be connected thereto and activated on to flash.

Figure 3:
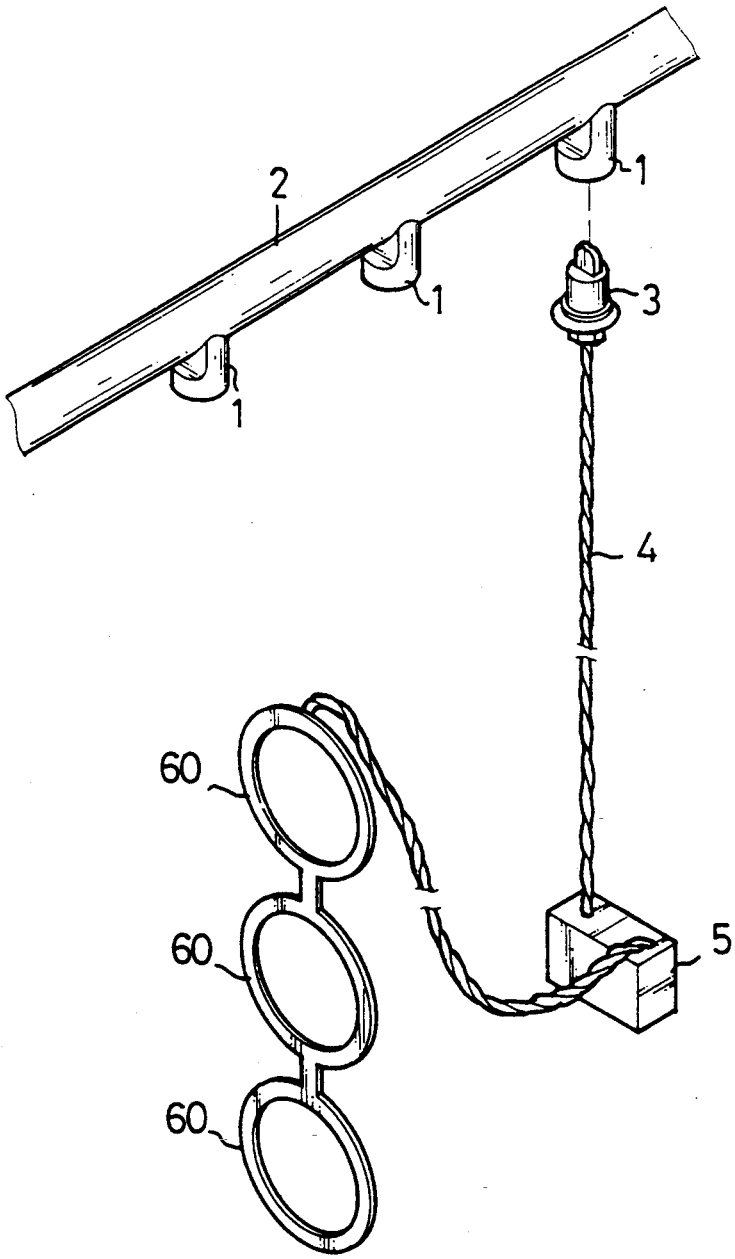
FIG. 3 illustrates the electro-luminescent seasonal component is formed as an alternative shape.

Referring to FIG. 3, the EL component 6 may be made as a plurality of connected rings 60 for providing versatility of the light pattern. Actually the EL component 6 can be formed to any contour the user prefers. For example, the rings 60 can be replaced with stars, hearts, word patterns, such as "MERRY CHRISTMAS", or any other shapes as the user requires. It should be noted that the electro-luminescent seasonal light apparatus can be used on seasonal occasions such as New year, Christmas, or Halloween.

Although the invention has been explained in relation to its preferred embodiment, it is to be understood that many other possible modifications and variations can be made without departing the spirit and scope of the invention as hereinafter claimed.

I claim:

1. An electro-luminescent seasonal light apparatus comprising a pig-tail plug mated with one pig-tail socket which extends from a regular seasonal Christmas/Halloween light string and provides a first AC power having a first voltage and a first frequency, an extension wire electrically connected to said pig-tail plug, a circuit box electrically connected to said extension wire for converting said first AC power to a second AC power having a second voltage and a second frequency, an electro-luminescent component electrically connected to said circuit box for receiving said second AC power and lighting up thereby, and a pattern shaper attached to said electro-luminescent component.

* * * * *